US006238239B1

(12) United States Patent
Wu

(10) Patent No.: US 6,238,239 B1
(45) Date of Patent: May 29, 2001

(54) WIRE-JOINTING ASSEMBLY FOR A JOINT BOX

(76) Inventor: Chun-Ching Wu, No 164-4, Aly q, LN 287, Sec 3, Chung-Shan Rd, Tan Tzu Township, Taichung County (TW)

( * ) Notice: Subject to any disclaimer, the term of this patent is extended or adjusted under 35 U.S.C. 154(b) by 0 days.

(21) Appl. No.: 09/547,017

(22) Filed: Apr. 11, 2000

(51) Int. Cl.[7] ..... H01R 13/60
(52) U.S. Cl. ..... 439/537; 174/50
(58) Field of Search ..... 439/537; 174/50, 174/61, 62

(56) References Cited

U.S. PATENT DOCUMENTS 2,208,558 * 7/1940 Appleton ..... 174/50
3,376,542 * 4/1968 Vlaminck ..... 439/571
3,798,584 * 3/1974 Person ..... 439/102
3,983,311 * 9/1976 Brumfield et al. ..... 174/50
3,985,417 * 10/1976 Fenton ..... 439/334
4,645,286 * 2/1987 Isban et al. ..... 439/571
4,647,725 * 3/1987 Dellinger et al. ..... 329/29
5,239,129 * 8/1993 Ehrenfels ..... 174/51

* cited by examiner

*Primary Examiner*—Tulsidas Patel
*Assistant Examiner*—Thanh-Tâm Lê
(74) *Attorney, Agent, or Firm*—Rosenberg, Klein & Lee

(57) ABSTRACT

A wire-jointing assembly is provided for a joint box of the type including a casing securely attached to a support rod of a ceiling fan, the joint box further comprising a switch seat and electric control devices mounted in the casing. The wire-jointing assembly includes a first wire-jointing seat and a second wire-jointing seat. The first wire-jointing seat is attached to the support rod of the ceiling fan and includes first side slots that are communicated with outside, each first side slot receiving a first wire that provides connection with the switch seat and the electric control devices. The second wire-jointing seat is secured to the switch seat and includes second side slots that are communicated with outside, each second side slot receiving a second wire that provides connection with the switch seat and the electric control devices. The first wire includes a first contact, and the second wire includes a second contact in electrical contact with the first contact of the first wire.

6 Claims, 5 Drawing Sheets

WIRE-JOINTING ASSEMBLY FOR A JOINT BOX

BACKGROUND OF THE INVENTION

1. Field of the Invention

The present invention relates to a wire-jointing assembly for a joint box, and more particularly to a wire-jointing assembly for a join box of a ceiling fan.

2. Description of the Related Art

It is common to install two sets of switches and a voltage-stabilizing rectifier in a joint box of a ceiling fan to control rotating speed and directions as well as stabilization of current or voltage. A considerable number of internal wires are required for connection with the fan motor, the wiring is thus complicated and the corresponding structures occupy a considerable space. Installation and maintenance are inconvenient and troublesome.

SUMMARY OF THE INVENTION

It is the primary object of the present invention to provide a wire-jointing assembly for a ceiling fan joint box that provides rapid connection and easy maintenance.

In accordance with the present invention, a wire-jointing assembly is provided for a joint box of the type comprising a casing securely attached to a support rod of a ceiling fan, the joint box further comprising a switch seat and electric control devices mounted in the casing. The wire-jointing assembly comprises:

a first wire-jointing seat attached to the support rod of the ceiling fan and including a plurality of first side slots that are communicated with outside, each said first side slot receiving a first wire that provides connection with the switch seat and the electric control devices; and a second wire-jointing seat secured to the switch seat and including a plurality of second side slots that are communicated with outside, each said second side slot receiving a second wire that provides connection with the switch seat and the electric control devices, the first wire including a first contact, and the second wire including a second contact in electrical contact with the first contact of the first wire.

The first wire-jointing seat is L-shape having a vertical section and a horizontal section in the form of a ring through which the support rod of the ceiling fan extends. The vertical section of the first wire-jointing seat includes a plurality of vertically spaced grooves. The first side slots are defined in the vertical section and each first side slot is communicated with an associated groove via a hole. The first contact of the first wire extends into an associated groove when the first wire is inserted into the associated first side slot. The vertical section of the first wire-jointing seat includes a nut secured thereto for engaging with a threaded section of the support rod of the ceiling fan.

The second wire-jointing seat includes an opening that faces outside, and the second side slots are communicated with the opening. The switch seat and the second wire-jointing seat are slidable one relative to the other.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
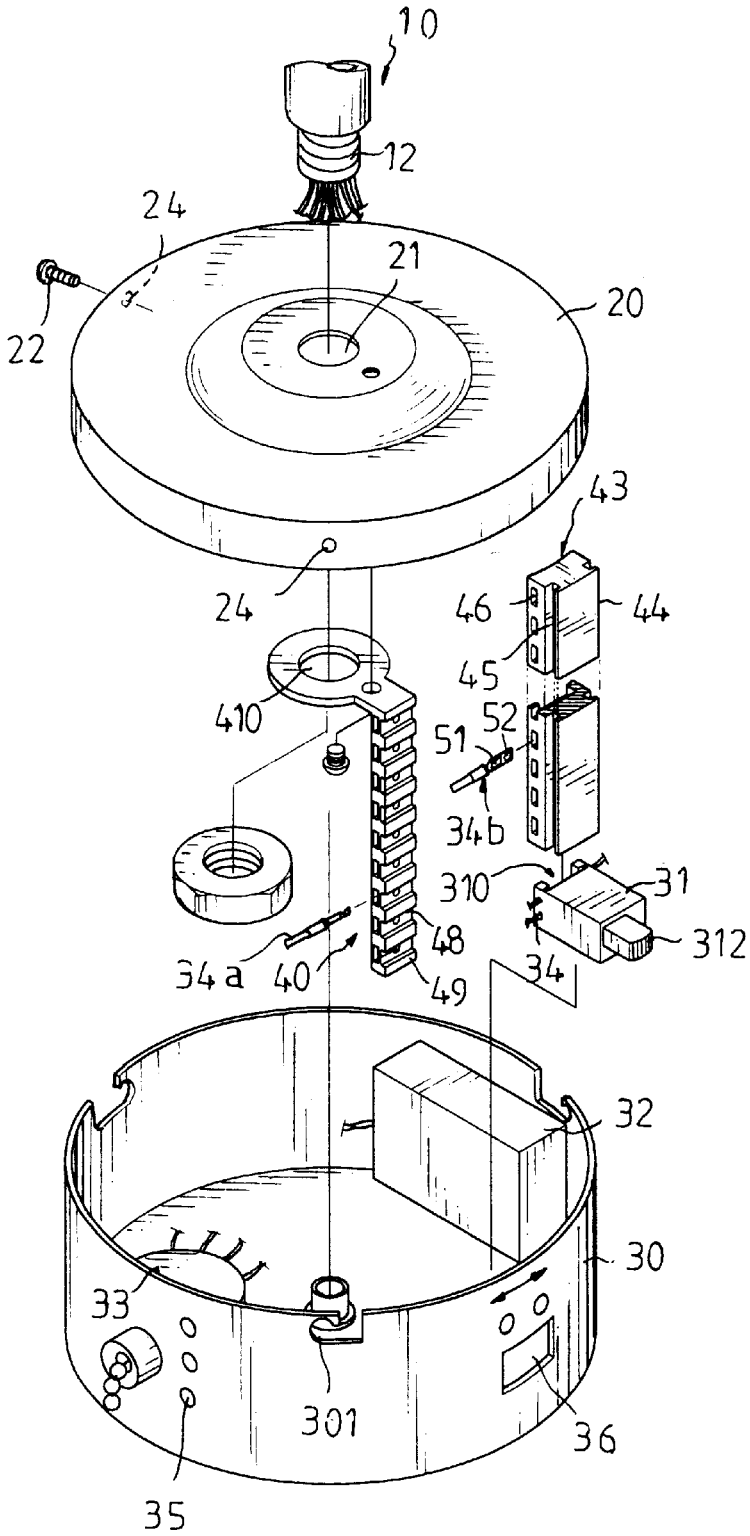
FIG. 1 is an exploded perspective view of a joint box for a ceiling fan in accordance with the present invention.
Figure 2:
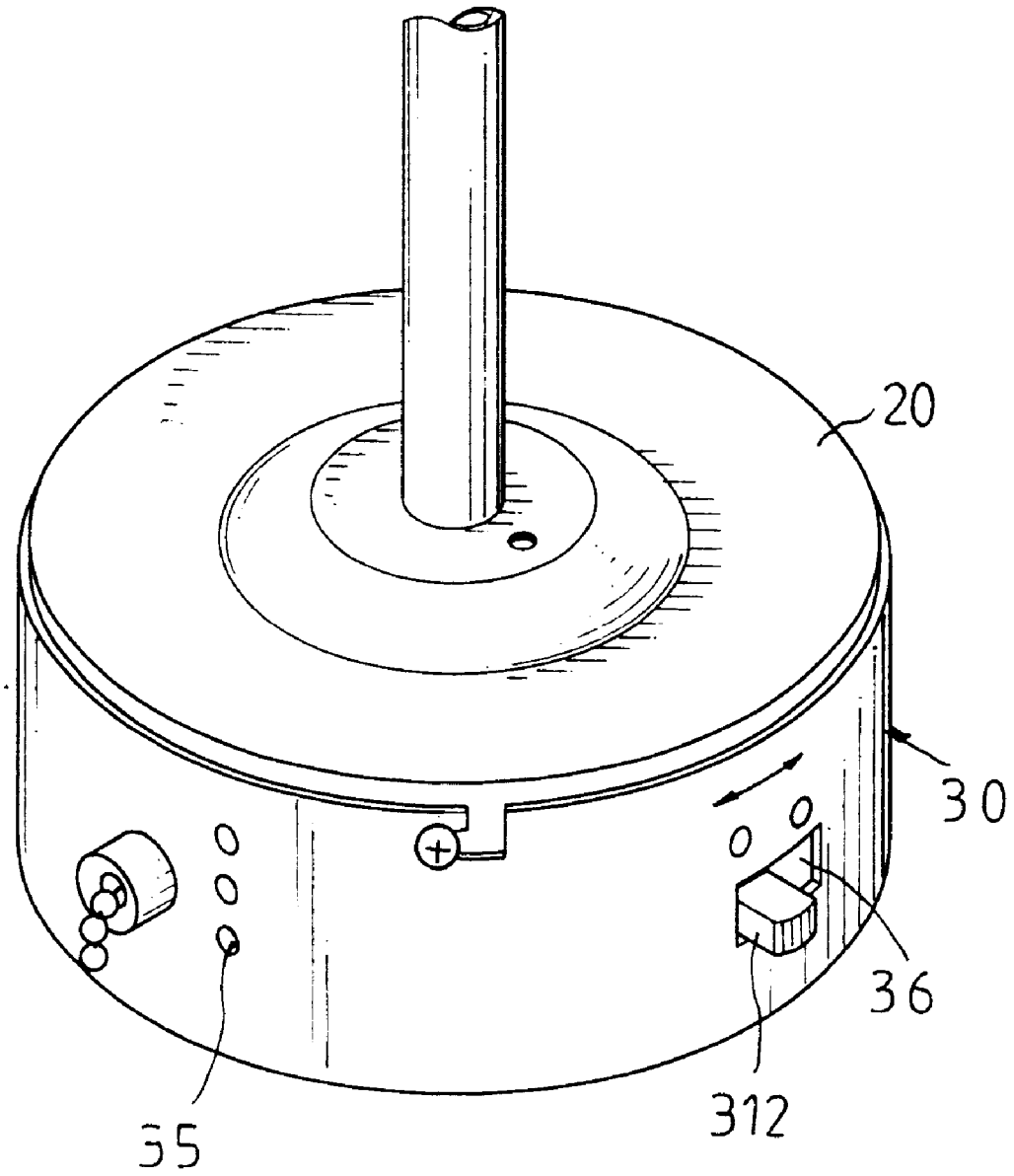
FIG. 2 is a perspective view of the joint box in FIG. 1.

Referring to FIGS. 1 and 2, a joint box in accordance with the present invention is attached to a support rod 10 for a ceiling fan (not shown). The joint box includes a casing 30 and a cover 20 for enclosing the casing 30. The cover 20 includes a central hole 21 through which the support rod 10 extends. The cover 20 further includes a number of holes 24 in an outer periphery thereof, the casing 30 includes a number of slots 301, and a number of bolts 22 are extended through the holes 24 and slots 301 to secure the cover 20 to the casing 30. Mounted in the casing 30 are a switch seat 31, a voltage-stabilizing rectifier 32, and a speed-controlling switch 33 that are connected by wires 34. A number of indication lamps 35 are provided adjacent to the switch seat 31 and the speed-controlling switch 33 for indicating operational status of the ceiling fan. In addition, the casing 30 includes a slot 36 through which a control button 312 of the switch seat 31 extends, as shown in FIG. 2.

The present invention is featured by that a wire-jointing assembly is mounted in the casing 30 and includes a first wire-jointing seat 40 and a second wire-jointing seat 44. The first wire-jointing seat 40 is substantially L-shape and includes a vertical section 49 and a horizontal section in the form of a ring 41. The ring 41 includes a hole 410 through which the support rod 10 extends. A nut 11 is secured to the vertical section 49 and aligned with the hole 410 for engaging with a threaded section 12 of the support rod 10. Thus, the first wire-jointing seat 40 is securely attached to the support rod 10. The vertical section 49 of the first wire-jointing seat 40 further includes a plurality of vertically spaced grooves 48 and a plurality of vertically spaced side slots 42 each of which is communicated with an associated groove 48 via a hole 47.

The second wire-jointing seat 44 is slidably engaged with the switch seat 31. In this embodiment, as shown in FIG. 1, the switch seat 31 includes a groove 310 and the second wire-jointing seat 44 includes a correspondingly shaped portion 45 to allow relative sliding motion therebetween. The second wire-jointing seat 44 further includes an opening 43 (FIG. 3) in a side thereof that faces outside. The second wire-jointing seat 44 further includes a plurality of side slots 46 that are communicated with the openings 43.

Figure 3:
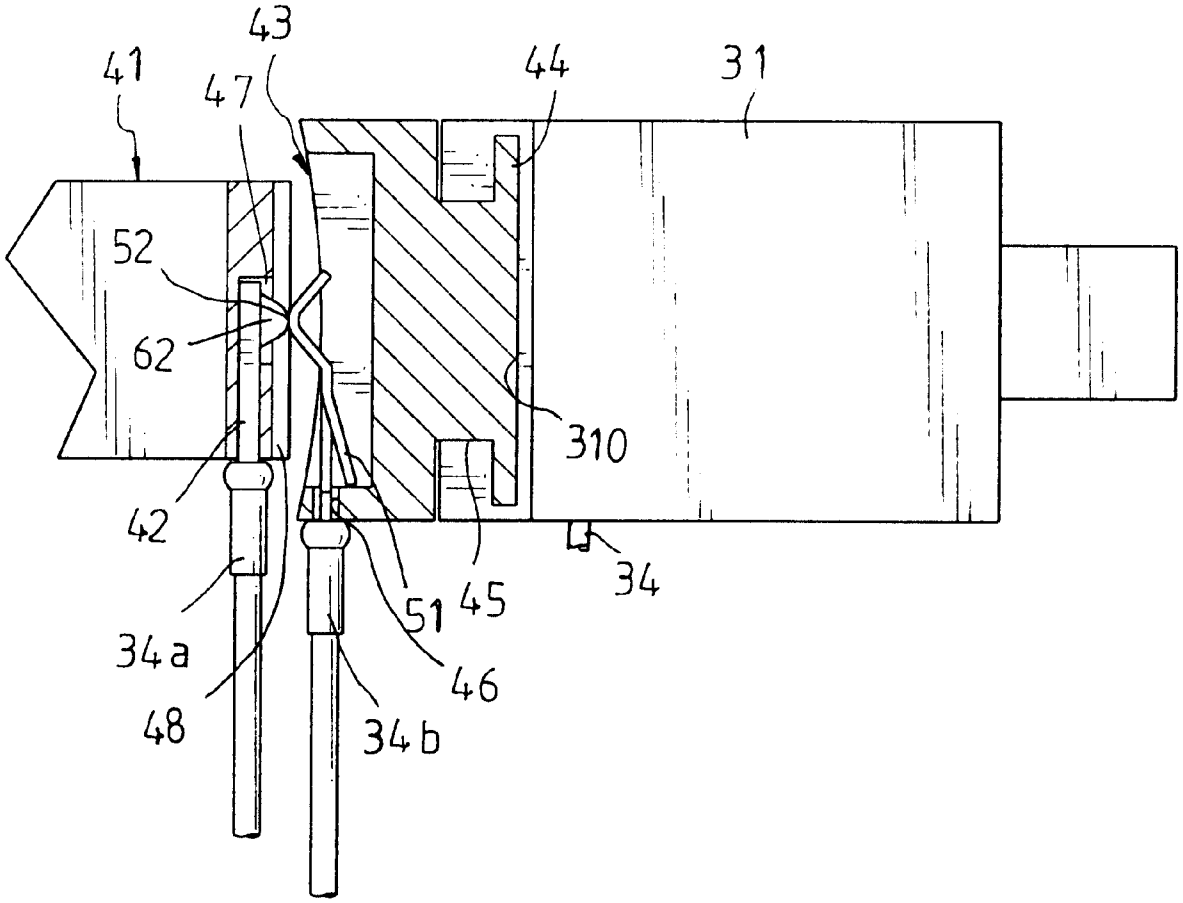
FIG. 3 is a partial sectional view illustrating electrical connection between two wire-jointing seats of a wire-jointing assembly in accordance with the present invention.

Turning to FIG. 3, a first wire (e.g., a wire from the speed-controlling switch 33) includes an end extended into an associated side slot 42 of the first wire-jointing seat 40 with a contact 62 of the first wire 34*a* extended into an associated groove 48 via an associated hole 47. A second wire 34*b* (e.g., a wire on the switch seat 31) includes an end extended into the opening 43 of the second wire-jointing seat 44 via an associated side slot 46. The end of the second wire 34*b* includes a contact 52 (e.g., an elastic contact) for electrical connection with the contact 62 of the first wire 34*a*. In addition, the end of the second wire 34*b* includes a portion 51 that prevents disengagement of the second wire 34*b* from the second wire-jointing seat 44.

Figure 4:
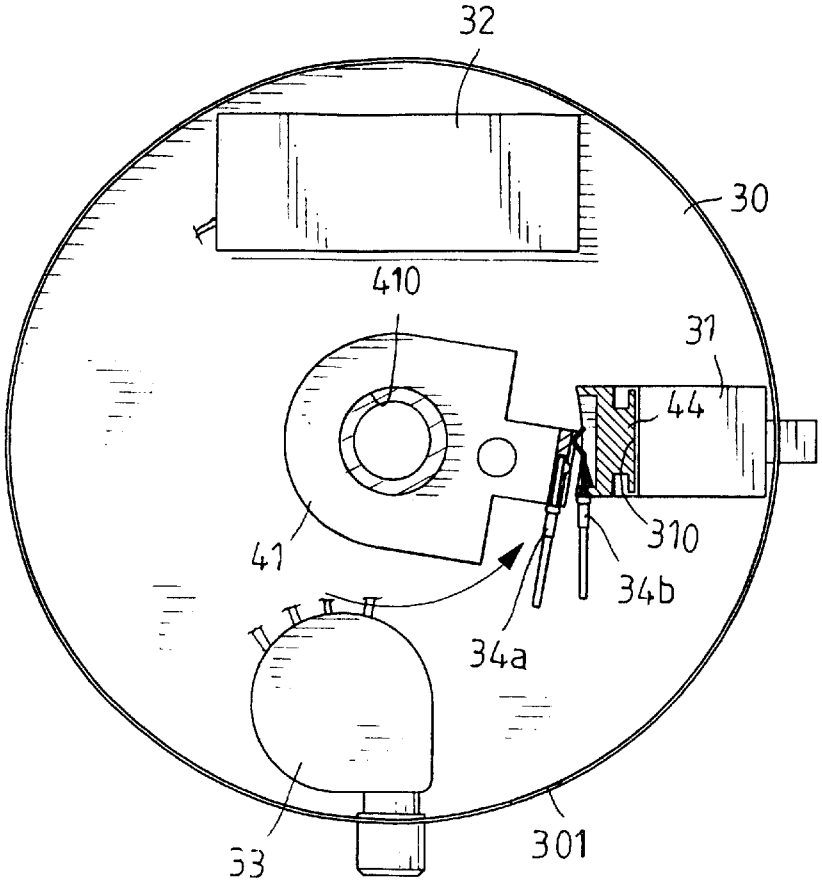
FIG. 4 is a top view, partly sectioned, of the joint box, illustrating movement for electrical connection between the wire-jointing seats.
Figure 5:
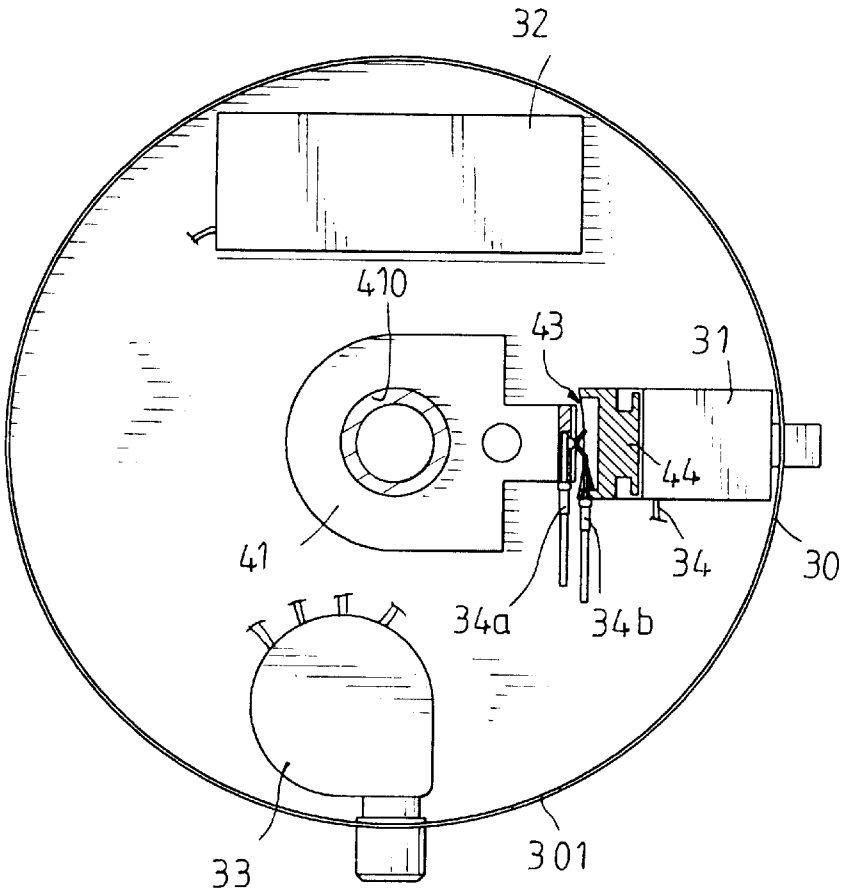
FIG. 5 is a view similar to FIG. 4, wherein the wire-jointing seats are electrically coupled.

FIGS. 4 and 5 illustrate movements for electrical connection between the first and second wires 34*a* and 34*b* of the first and second wire-jointing seats 40 and 44. The first wire 34*a* in FIG. 4 will be in electrical contact with the second wire 34*b* after the first wire-jointing seat 40 is turned through an angle to a position shown in FIG. 5. No additional wire connection is required.

According to the above description, it is appreciated that the wires 34 can be rapidly installed and connected without additional wire connection and thus provides a plug-and-use function. In addition, identification of the wires 34 directly inserted into the wire-jointing assembly is easy, thereby providing convenient installation and maintenance.

Although the invention has been explained in relation to its preferred embodiment, it is to be understood that many other possible modifications and variations can be made without departing from the spirit and scope of the invention as hereinafter claimed.

What is claimed is:

1. A wire-jointing assembly for a joint box comprising a casing securely attached to a support rod of a ceiling fan, the joint box further comprising a switch seat and electric-control devices mounted in the casing, the wire-jointing assembly comprising:

a first wire-jointing seat attached to the support rod of the ceiling fan and including a plurality of first side slots that are communicated with outside, each said first side slot receiving a first wire that provides connection with the switch seat and the electric control devices; and a second wire-jointing seat secured to the switch seat and including a plurality of second side slots that are communicated with outside, each said second side slot receiving a second wire that provides connection with the switch seat and the electric control devices, the first wire including a first contact, and the second wire including a second contact in electrical contact with the first contact of the first wire.

2. The wire-jointing assembly as claimed in claim 1, wherein the first wire-jointing seat is L-shape having a vertical section and a horizontal section in the form of a ring through which the support rod of the ceiling fan extends, the vertical section of the first wire-jointing seat including a plurality of vertically spaced grooves, the first side slots being defined in the vertical section, each said first side slot being communicated with an associated said groove via a hole.

3. The wire-jointing assembly as claimed in claim 2, wherein the first contact of the first wire extends into an associated said groove when the first wire is inserted into the associated said first side slot.

4. The wire-jointing assembly as claimed in claim 2, wherein the vertical section of the first wire-jointing seat includes a nut secured thereto for engaging with a threaded section of the support rod of the ceiling fan.

5. The wire-jointing assembly as claimed in claim 1, wherein the second wire-jointing seat includes an opening that faces outside, and the second side slots are communicated with the opening.

6. The wire-jointing assembly as claimed in claim 5, wherein the switch seat and the second wire-jointing seat are slidable one relative to the other.

* * * * *